US012703544B2

(12) United States Patent
Bogdanov et al.

(10) Patent No.: US 12,703,544 B2
(45) Date of Patent: Aug. 11, 2026

(54) FOOD CONTAINER WITH RESEALABLE CAP

(71) Applicant: General Mills, Inc., Minneapolis, MN (US)

(72) Inventors: Emil Bogdanov, Excelsior, MN (US); Bradley Hannah, Murfreesboro, TN (US); Mary K. Lash, Minneapolis, MN (US); James Popp, Minneapolis, MN (US); Joseph M. Touchet, Robbinsdale, MN (US)

(73) Assignee: General Mills, Inc., Minneapolis, MN (US)

( * ) Notice: Subject to any disclaimer, the term of this patent is extended or adjusted under 35 U.S.C. 154(b) by 54 days.

(21) Appl. No.: 18/783,823

(22) Filed: Jul. 25, 2024

(65) Prior Publication Data

US 2025/0033837 A1 Jan. 30, 2025

Related U.S. Application Data

(60) Provisional application No. 63/529,218, filed on Jul. 27, 2023.

(51) Int. Cl.
*B65D 41/48* (2006.01)
*B65D 65/38* (2006.01)

(52) U.S. Cl.
CPC ..... *B65D 41/485* (2013.01); *B65D 65/38* (2013.01); *B65D 2401/15* (2020.05); *B65D 2565/386* (2013.01)

(58) Field of Classification Search
CPC ..... B65D 41/485; B65D 41/48; B65D 41/46; B65D 65/38; B65D 77/2024;
(Continued)

(56) References Cited

U.S. PATENT DOCUMENTS 4,966,302 A * 10/1990 Hjordie ..... B65D 45/20 220/792
5,437,386 A * 8/1995 Von Holdt ..... B65D 43/0212 220/268
(Continued)

FOREIGN PATENT DOCUMENTS

AT 500137 11/2005
AT 516596 6/2016
(Continued)

*Primary Examiner* — Robert J Hicks
(74) *Attorney, Agent, or Firm* — Jordan IP Law, LLC; Annette M. Frawley, Esq.

(57) ABSTRACT

A food container includes a main plastic body terminating in an upper rim having a ledge portion, a resealable cap configured to seal against the ledge portion when snap-connected to the upper rim and an externally visible tamper indicator integrated into the container body below the upper rim. The cap includes an opening tab which, upon initially opening the container, is lifted to break one or more frangible connections with the tamper indicator. When the food container cap is presented for sale, the tamper indicator is clearly visible to a consumer. When the cap is completely removed, the tamper indicator radially projects from the container body. The cap can be used to selectively reseal the main body upon seating the seal portion on the ledge portion and snap-connecting the cap to the upper rim.

14 Claims, 5 Drawing Sheets

(58) Field of Classification Search

CPC ..... B65D 17/4011; B65D 17/404; B65D 17/402; B65D 2251/0093; B65D 2543/00296; B65D 2577/205; B65D 2565/386; B65D 2565/385; B65D 2565/381; B65D 2401/50; B65D 2401/25; B65D 2401/30; B65D 2401/15

USPC ..... 220/270, 268, 266, 265, 359.2, 359.1; 215/251, 250

See application file for complete search history.

(56) References Cited

U.S. PATENT DOCUMENTS

| | | | | |
|---|---|---|---|---|
| 7,117,579 | B2 | 10/2006 | Schellenberg | |
| 7,967,187 | B2 | 6/2011 | Yukumoto et al. | |
| 8,758,665 | B2 | 6/2014 | Riethmueller | |
| 8,939,187 | B2 | 1/2015 | Riethmueller et al. | |
| D732,352 | S | 6/2015 | Ebli | |
| D732,902 | S | 6/2015 | Elbi | |
| 9,676,504 | B2 | 6/2017 | Minnette et al. | |
| 2004/0232149 | A1* | 11/2004 | Chmela | B65D 41/48 220/270 |
| 2007/0062949 | A1 | 3/2007 | Bordner | |
| 2014/0308404 | A1 | 10/2014 | Crawford | |
| 2015/0367990 | A1 | 12/2015 | Sinha et al. | |
| 2022/0073238 | A1* | 3/2022 | Naumann | B65D 55/16 |
| 2022/0227524 | A1 | 7/2022 | Riethmueller | |

FOREIGN PATENT DOCUMENTS

| | | |
|---|---|---|
| AT | 519129 | 4/2018 |
| AT | 519214 | 4/2018 |
| AT | 519670 | 9/2018 |
| AT | 519791 | 10/2018 |
| AT | 520218 | 2/2019 |
| AT | 522461 | 11/2020 |
| DE | 102019002040 | 9/2020 |
| EP | 1876106 | 1/2008 |
| EP | 1894847 | 3/2008 |
| EP | 3173351 | 5/2017 |
| EP | 3401231 | 11/2018 |
| EP | 3514080 | 7/2019 |
| EP | 3552791 | 10/2019 |
| RU | 2543454 | 2/2015 |
| WO | WO 2009/130043 | 10/2009 |
| WO | WO 2011/092142 | 8/2011 |
| WO | WO 2012/021915 | 2/2012 |
| WO | WO 2013/040621 | 3/2013 |
| WO | WO 2014/128167 | 8/2014 |
| WO | WO 2015/004118 | 1/2015 |
| WO | WO 2015/124530 | 8/2015 |
| WO | WO 2018/059878 | 4/2018 |
| WO | WO 2019/056033 | 3/2019 |
| WO | WO 2019/195869 | 10/2019 |
| WO | WO 2020/016411 | 1/2020 |
| WO | WO 2020/161361 | 8/2020 |
| WO | WO 2022/051793 | 3/2022 |
| WO | WO 2022/120399 | 6/2022 |
| WO | WO 2022/180078 | 9/2022 |
| WO | WO 2022/180079 | 9/2022 |

* cited by examiner

FOOD CONTAINER WITH RESEALABLE CAP

CROSS REFERENCE TO RELATED APPLICATIONS

This application claims the benefit of U.S. Provisional Patent Application No. 63/529,218, filed on Jul. 27, 2023 and titled "Food Container with Resealable Cap". The entire content of this application is incorporated by reference.

FIELD OF THE INVENTION

The invention generally pertains to packaging food products and, more particularly, to providing a food storage container employing a resealable cap and a tamper indicator.

BACKGROUND OF THE INVENTION

Certainly, a wide variety of packaging arrangements are employed in the food art. In particular, in connection with perishable food items, considerable effort has been made to design food containers in which food products can be effectively sealed in order to, among other reasons, prevent contamination and enhance the shelf life of the food products. In particular connection with food containers having plastic main bodies, one prevalent type of food packaging arrangement employs a flexible membrane, such as a foil or film seal. Since the flexible membrane, once removed, cannot be resealed, a food container of this type generally also includes a plastic cap which functions to at least cover any remaining food in the container for future use. However, the cap alone does not create a seal between the food product in the container and the environment, so the life of the food product is greatly reduced after initially being opened.

FIG. 1 illustrates an exemplary known food product container constructed in the manner described above. Generically, this food product container, generally indicated at 2, can be used in connection with packaging a wide range of food products ranging from food products which need to be stored in refrigerated conditions, e.g., yogurt, foods which are intended to be stored under non-refrigerated conditions, e.g., powdered drink mixes, and foods which need to be refrigerated only after being initially unsealed, e.g., cake frosting. In any case, as shown, food container 2 includes a main body 5 for housing the food (not shown), with the main body 5 including an upstanding sidewall portion 8 terminating in an annular peripheral rim 10. Scaled circumferentially to rim 10 is a flexible membrane 12, shown in the form of a foil seal having an extension tab 15 which is intended to be grasped by a user in order to remove flexible membrane 12. Food container 2 also includes a cap 18 which snaps about rim 10, over flexible membrane 12.

With this construction, initially accessing the food product stored in container 2 requires removing cap 18 and pealing flexible membrane 12 through the use of extension tab 15. Through this peeling, membrane 12 is detached from rim 10 and cannot be resealed thereon by the consumer. Although container 2 and cap 18 are often made from recyclable materials, known flexible membranes, including foil or film seals, are not made of 100% recyclable materials and therefore must be trashed. In particular, if known flexible sealing membranes are introduced into recycling material, they can cause damage the machinery or otherwise impede the overall recycling process, e.g., they can get caught up in gears intended to grind and reduce plastics. Assuming the entire contents of container 2 is not used, even though cap 18 can be reattached to close off an open top of container 2, the food product will no longer be sealed within container 2 but instead will be easily exposed to the environmental conditions of the designated storage area and, regardless of the content, will experience a significantly reduced shelf life. Not only does this common food container configuration require multiple steps to access the food product, but the need to throw away the flexible membrane is not environmentally friendly.

In overcoming the issues raised above, it is considered desirable in accordance with the invention to provide a food container made from 100% recyclable materials, constructed so as to be easier to open, and designed to be readily resealed when the contents thereof are not fully depleted. In addition, it is desirable to provide the container with an unauthorized tamper indicator. That is, even when container 2 is being displayed for sale at a grocery store, both cap 18 and flexible membrane 12 of container 2 can be removed to expose the food, the food tampered with and then at least cap 18 reattached. Another, unsuspecting consumer could then purchase container 2 without realizing the tampering until he/she desires to access the contents. Therefore, it would be desirable to deter the occurrence of this situation, particularly by incorporating structure into the container which not only deters such actions but provides a clear, externally visually apparent indication when the product has been tampered with, thereby assuring the consumer of the integrity of the product.

SUMMARY OF THE INVENTION

A food container according to the invention incorporates a resealable cap and includes an externally visible tamper indicator. More specifically, a food container constructed in accordance with the invention includes a main plastic body, terminating in an upper rim having a ledge portion, and a cap which is configured to seal against the ledge portion when snap-connected to the upper rim. In this manner, the connection of the cap to the main container body seals the contents of the container, without the need for a flexible membrane, particularly a foil or film seal, such that the entire food container is made from 100% recyclable materials. In addition, the cap includes an opening tab which, upon initially opening the container, is lifted to break one or more frangible connections with a tamper indicator integrated into the container body below the upper rim. With this construction, the food container cap is presented for sale having the cap attached to the tamper indicator, with the attachment being clearly visible to a consumer viewing the product. When the cap is completely removed, the tamper indicator radially projects from the container body. The cap can be selectively reengaged with the container body, wherein an outer portion of the cap closely follows the contour of the upper rim such that a seal portion of the cap seats on the ledge portion of the container body and a downturned portion of the cap snap-fittingly engages about a lower flange of the upper rim, effectively re-sealing the food container along the ledge portion.

Additional objects, features and advantages of the invention will become more readily apparent from the following detailed description of the invention wherein like reference numerals review to corresponding parts in the several views.

DETAILED DESCRIPTION OF EMBODIMENTS

Figure 1:
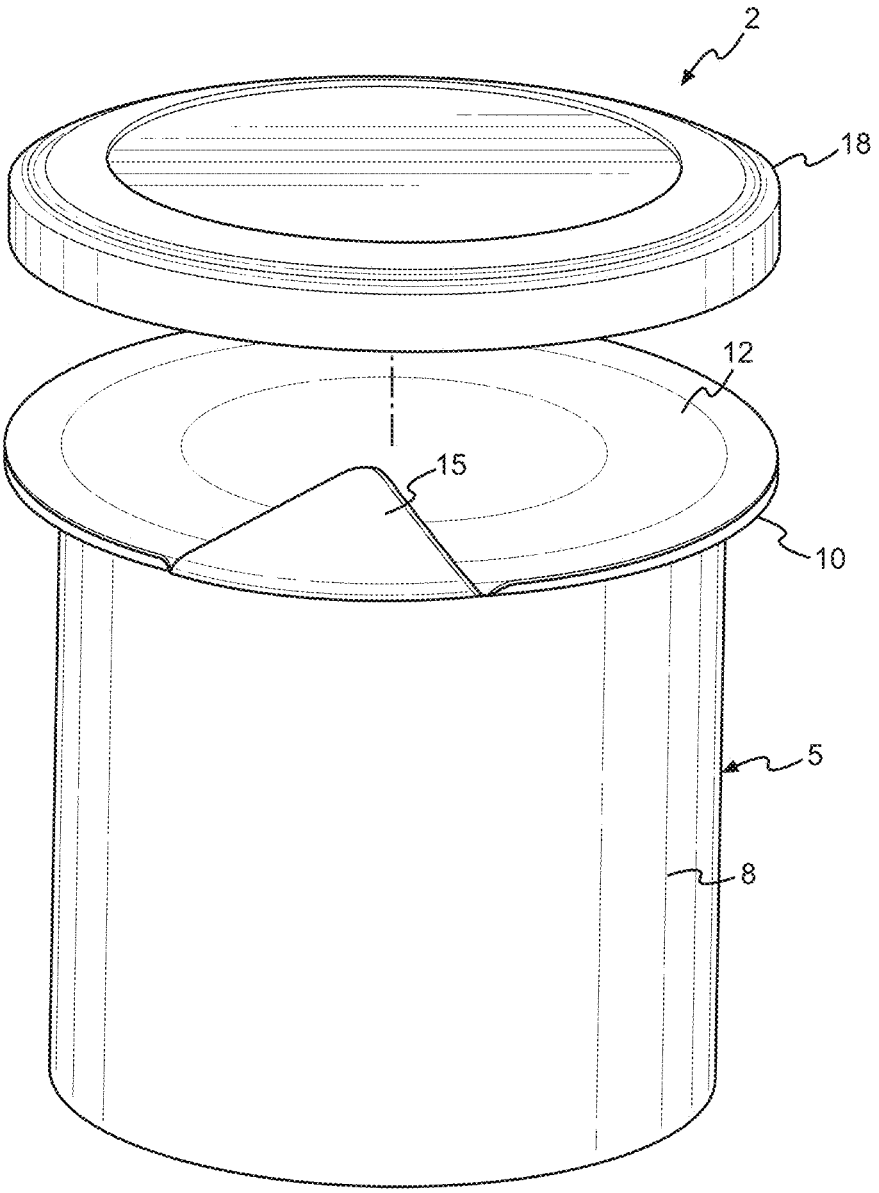
FIG. 1 PRIOR ART
FIG. 1 is a partially exploded view of a food container constructed in a manner known in the art.
Figure 2:
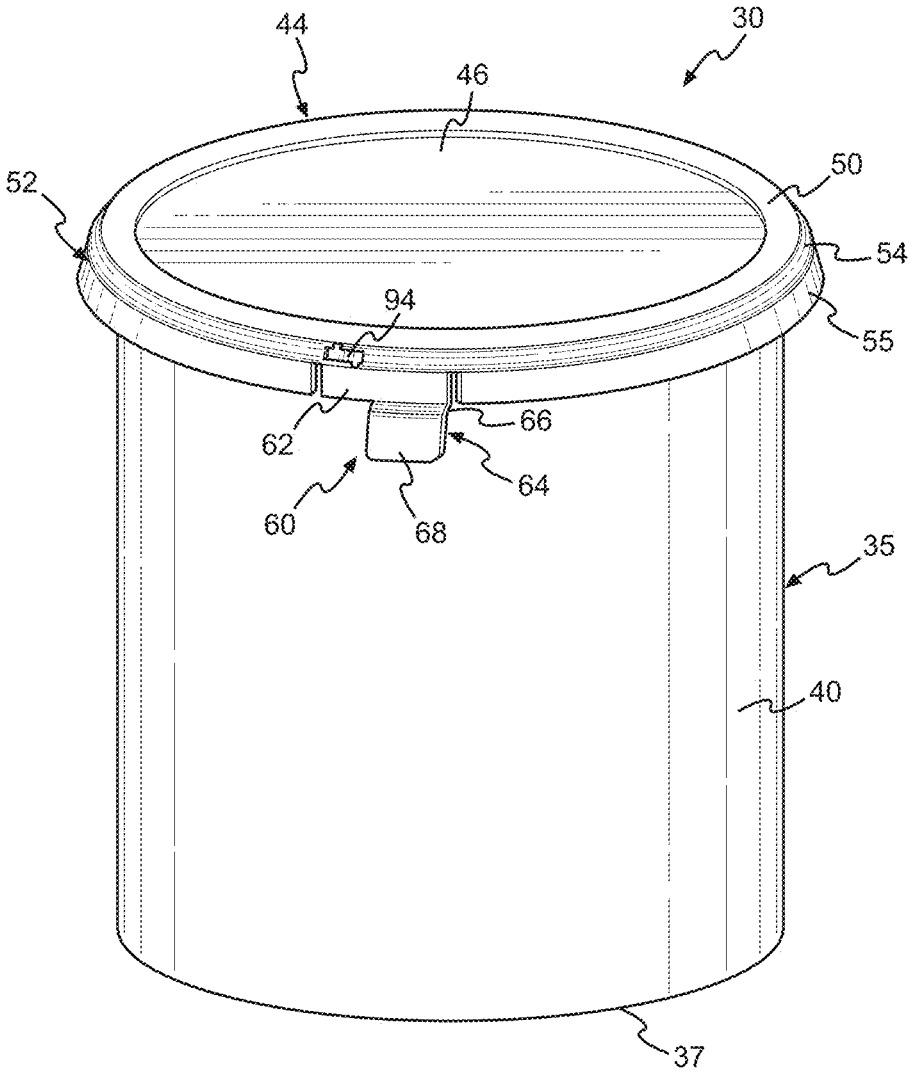
FIG. 2 is an upper front perspective view of a food container with a resealable cap according to the invention.

With initial reference to FIG. 2, a food container constructed in accordance with the present invention is generally indicated at 30. Container 30 includes a rigid main body 35 which is preferably molded of recyclable plastic and includes a bottom 37 joined to at least one sidewall 40. In the embodiment shown, a single annular sidewall 40 which is cylindrical in shape is employed, but any geometric shape and number of sidewalls could be utilized in accordance with the invention. Container 30 also includes a cap 44 including a compartment cover portion 46, a seal portion 50 and a downturned portion 52. As depicted and discussed further below, downturned portion 52 includes a first section 54 leading from seal portion 50 to a second section 55. As also depicted in this figure, cap 44 of container 30 includes an opening tab 60. In the embodiment shown, opening tab 60 includes an upper tab body 62 and a lower tab body 64, with lower tab body 64 having an out-turned section 66 and a downturned section 68.

Figure 3:
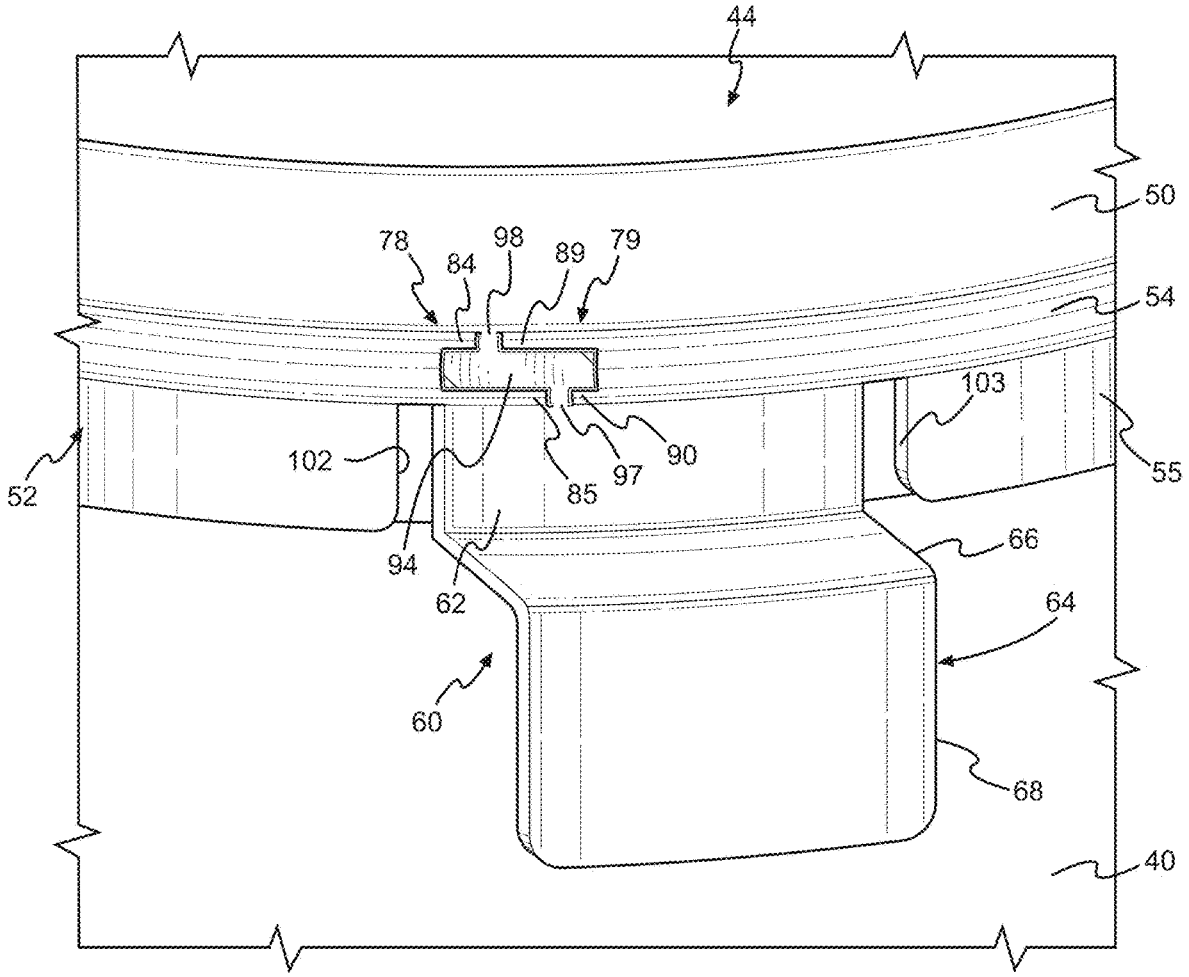
FIG. 3 is an enlarged view about an opening tab portion of the resealable cap of FIG. 2.

As best shown in FIGS. 2 and 3, downturned portion 52 does not extend entirely, circumferentially about main body 35. Instead, first section 54 of downturned portion 52 includes a first terminal end 78 and a second terminal end 79 which is spaced from first terminal end 78. In the particular embodiment depicted, first terminal end 78 is defined by a first, short upper leg 84 which is spaced from and extends substantially parallel to a second, longer lower leg 85. In a generally reverse manner, second terminal end 79 is defined by a first, elongated upper leg 89 and a second, shorter lower leg 90 which is spaced from and substantially parallel to upper leg 89. As clearly shown, first and second terminal ends 78 and 79 are circumferentially spaced from each other, while first upper legs 84 and 89 are vertically spaced from second lower legs 85 and 90.

With this construction, an open region (not separately labeled) is created along first section 54 of downturned portion 52, between first and second terminal ends 78 and 79, with a tamper indicator 94 being located within this open region. At this point it should be noted that tamper indicator 94 can take various geometric configurations without departing from the invention. For instance, although not shown, the corners of tamper indicator 94 could be angled which can potentially aid in formation during injection molding. Regardless, importantly, tamper indicator 94 is integrated into main body 35, such as being integrally molded with, welded to or otherwise fixedly secured to main body 35. In addition, tamper indicator 94 is attached to opening tab 60 through a frangible element 97. Actually, in the preferred embodiment shown, tamper indicator 94 is also connected to seal portion 50 of cap 44 through an additional frangible element 98. At this same time, tamper indicator 94 is substantially surrounded by, but spaced from, first and second terminal ends 78 and 79. In addition, second section 55 of downturned portion 52 includes first and second terminal ends 102 and 103 and upper tab body 62 of opening tab 60 extends between, but is spaced from, both first and second terminal ends 102 and 103. On the other hand, second section 55 of downturned portion 52 is integrally formed with or otherwise attached to first and second terminal ends 78 and 79 of first section 54 of downturned portion 52.

Figure 4:
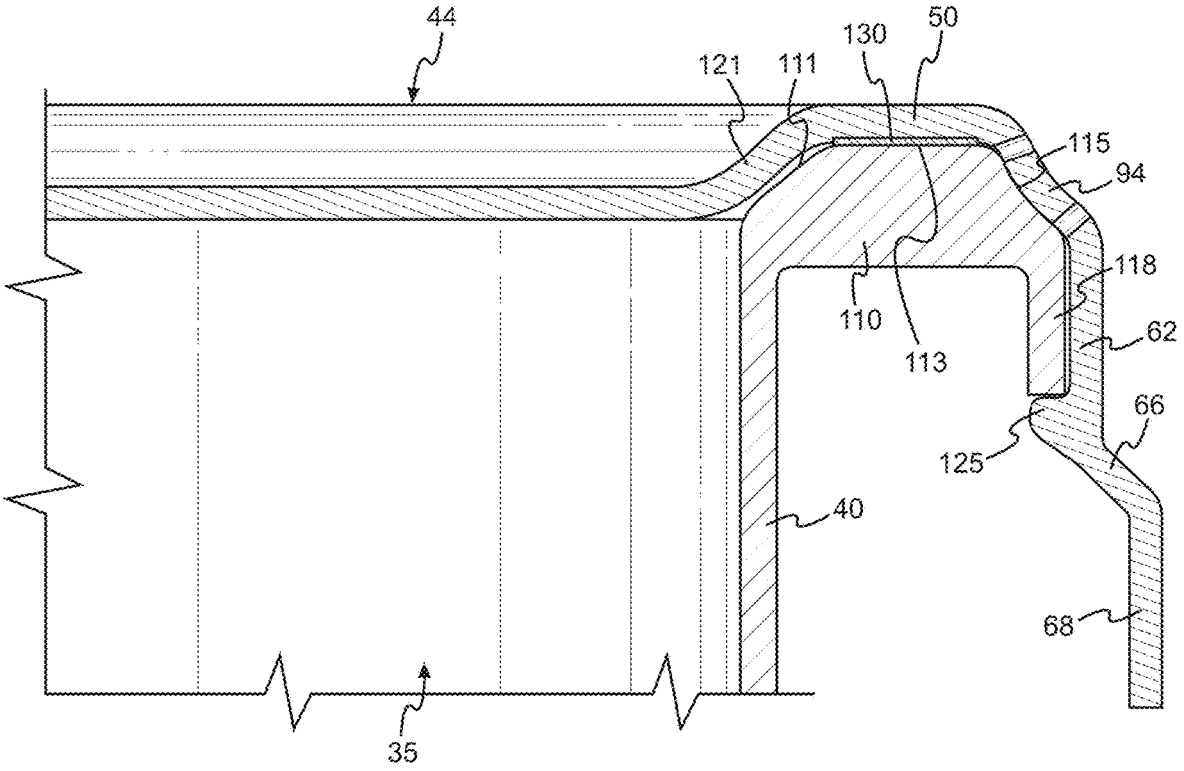
FIG. 4 is a cross-sectional view of a portion of the food container of FIG. 1, showing the manner in which the cap is attached and sealed to a main body of the container.

Before detailing the manner in which food container 30 can be opened and then rescaled in accordance with the invention, reference is made to FIG. 4 which illustrates the scaling position of cap 44 upon main body 35. More specifically, the cross-sectional view of FIG. 4 illustrates an upper rim 110 extending radially outward from sidewall 40 of main body 35, with upper rim 110 shown to include an angled portion 111 transitioning to a substantially flat and annular ledge portion 113. From ledge portion 113, upper rim 110 includes a transition section 115 which leads to a lower flange 118. As also depicted in this figure, cap 44 closely follows the contour of upper rim 110 with the inclusion of an angled portion 121 juxtapose angled portion 111, seal portion 50 extending flat across ledge portion 113, first section 54 of downturned portion 52 of cap 44 tracking transition section 115 and upper tab body 62 extending along lower flange 118. In addition, extending radially inward from upper tab body 62 is a projection 125. Although not separately shown, a corresponding, elongated projection extends entirely about lower ends of second section 55. With this construction, upon seating cap 44 on main body 35, the projections snap beneath lower flange 118 almost entirely around upper rim 110 when seal portion 50 seats against ledge portion 113.

As indicated above, it is one main aspect of the invention that cap 44 provides an initial seal for main body 35, is peelable in order to open container 30, and can be reseated to effectively reseal main body 35. In accordance with the invention, it has been found that these functions can be performed in a few ways. In certain embodiments, seal portion 50 and/or ledge portion 113 has a sealant applied thereto, such as via in-mold labeling, co-extrusion, over-injection, spraying, stamping or printing. In the preferred embodiment depicted in FIG. 4, an annular seal member 130 is established by applying a sealant in a manner comparable to in-mold labeling along seal portion 50. Seal member 130 can be quite thin, for instance constituting an approximately 2 mil layer embedded in seal portion 50, while having an approximate width of 0.125 inches (as opposed to being laminated across the entire seal portion 50) and constituting approximately 0.5-4% of the total cap composition by weight. In certain preferred embodiments, the sealant has a bond strength exceeding 800 g/cm with the structure of cap 44 and melts within 120-300 degrees Fahrenheit. In accordance with a preferred design, seal member 130 is capable of holding internal air pressure of at least 4 psi over a 3 hour duration, while being peelable by hand. Seal portion 50 and/or ledge portion 113 may be additionally pre-treated prior to the formation of seal member 130 through energy application, such as localized heat (e.g., hot air) transfer, laser engraving, corona flame or other surface modifications. In each case, it is important to note that one or more of these mating surfaces is specially constructed, at least to provide a strong enough seal yet be comfortably peelable, versus a standard food container cap arrangement such that, with each form of preparation, seal portion 50 and ledge portion 113 can be held in engagement through the established snap connection. Although this engagement could be relied upon for an initial seal, further bonding between seal portion 50 and ledge portion 113 is preferably provided during manufacturing, such as relying on heat and pressure, induction, ultrasonic or other known weld techniques, to establish a more robust seal. Therefore, it should be understood that the "reseal" associated with the seating of cap 44 on main body 35 after container 30 is initially opened effectively reseals food container 30 in order to enhance the shelf life of any remaining product, but a further degree of sealing to establish a hermetic seal is assured during the manufacturing process. This distinction can be quantified in various ways, including the peel force associated with removing cap 44. In accordance with a particular embodiment of the invention, the peak peel force needed to initially remove cap 44 is between 3-9 lbs, while the peak peel force needed to remove cap 44 after being reseated is between 2-6 lbs.

Figure 5:
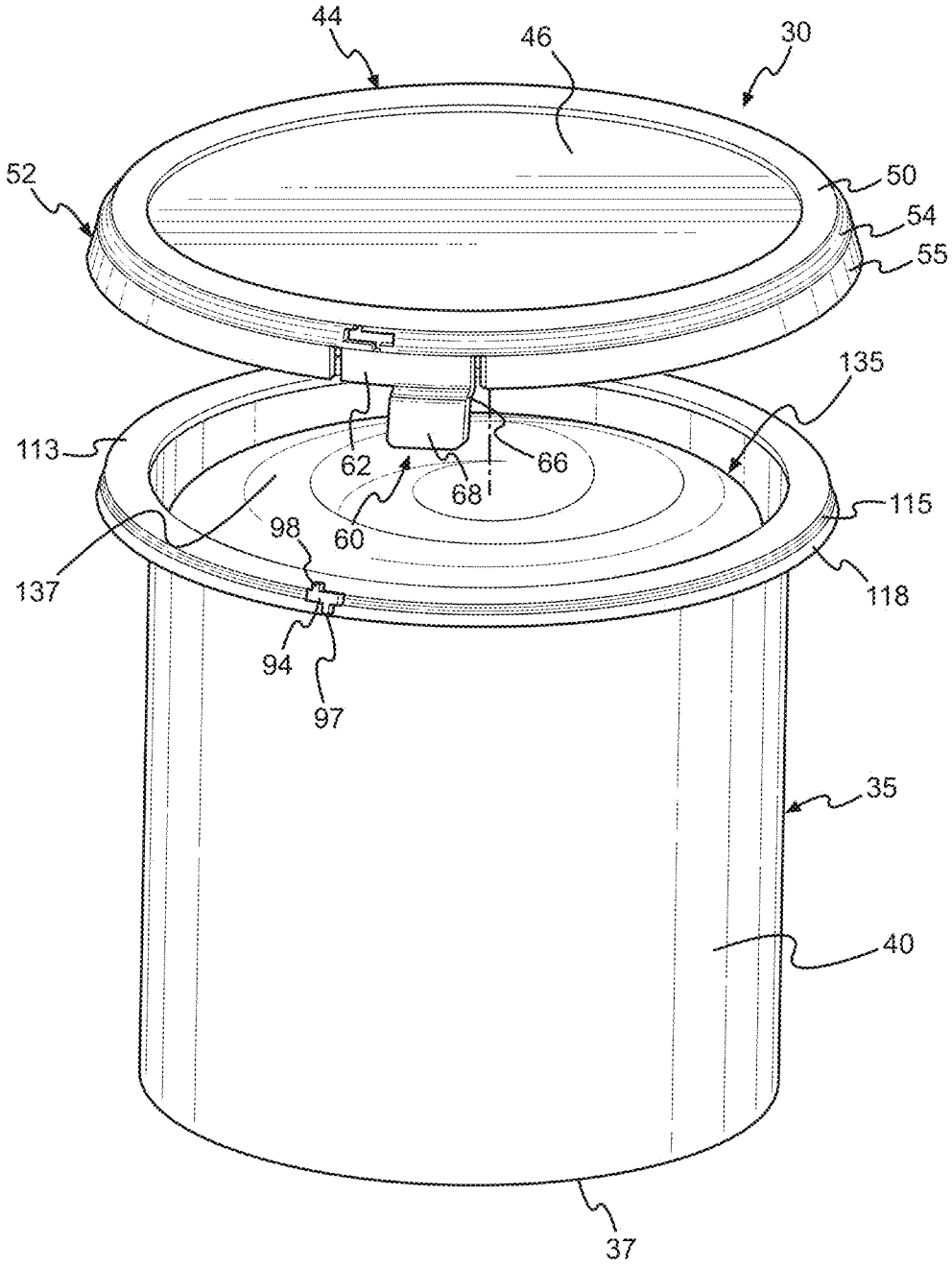
FIG. 5 shows the food container of FIG. 2 with the resealable cap removed from the main body of the container.

FIG. 5 shows cap 44 removed from main body 35 to expose an interior compartment 135 shown to be filled with a food product 137. Certainly, food product 137 can take various forms within the scope of the invention. In accordance with certain preferred embodiments of the invention, food product 137 is constituted by an edible composition which needs to be refrigerated after opening, such as cake frosting. In other embodiments, the food product 137 can require refrigeration prior to being consumed, or may be a product which does not require refrigeration at all. However, at the very least, food product 137 is of the type which will have a shortened life if not maintained effectively sealed between being accessed. Important in connection with the invention is the manner in which container 30 can be opened and rescaled. More specifically, upon initially being purchased by a consumer, container 30 takes the form represented in FIGS. 2-4 wherein cap 44 is snap-connected on main body 35, interior compartment 135 is sealed through both seal member 130 and known weld techniques at least along ledge portion 113, and frangible elements 97 and 98 connect tamper indicator 94 to cap 44. With tamper indicator 94 attached to cap 44 in this manner, the consumer is provided with a readily visible indication that cap 44 has never been removed from container 30, i.e., container 30 has never been opened. When first opening container 30, tab 60 is manually manipulated by grasping downturned section 68, which is advantageously spaced from sidewall 40, and pulling the same away from main body 35. Since tamper indicator 94, as well as frangible elements 97 and 98 in one form of the invention, is fixed to main body 35, pulling and lifting of opening tab 60 will cause frangible elements 97 and 98 to break from cap 44, and continued pulling will release the seal. The breaking of the frangible connections is actually designed so as to be felt, seen and/or heard in order to specifically provide the consumer with confidence that the original seal established upon manufacturing the product was properly created and intact. Thereafter, cap 44 can be removed from around upper rim 110 to directly expose interior compartment 135 and food product 137. Based thereon it should be recognized that, in accordance with the invention, there is no flexible membrane seal (foil, film or otherwise) and the entire container is made from 100% recyclable material.

If it is desired to effectively reseal container 30 to extend the useful life of any remaining portion of food product 137, cap 44 can be employed alone for this purpose. More specifically, cap 44 can be remounted by pressing cap 44 to follow the contour of upper rim 110 and seat seal portion 50 of cap 44 upon ledge portion 113 of upper rim 110. In connection with this remounting step, cap 44 is not required to be aligned with tamper indicator 94, i.e., position tamper indicator 94 in the space established between first and second terminal ends 78 and 79 of first section 54 of downturned section 52, if tamper indicator 94 is made thin and at least second section 55 of cap 44 is quite flexible. In any case, when properly seated, opening tab 60 and second section 55 will be snap-connected about lower flange 118 of upper rim 110.

With the above in mind, it should be readily apparent that the present invention provides for the incorporation of strategically located structure into the container which not only deters any pre-purchase tampering with the product but also provides both a clear, externally visually apparent indication if the product had been tampered with and also that the product was properly sealed, thereby assuring the consumer of the seal integrity of the product both at the time of purchase and at the time of first opening. In addition, the structure and operation of the invention does away with the need for a redundant and non-recyclable flexible membrane seal which, in turn, advantageously enables the entire container to be made from 100% recyclable material in order to exhibit a better environmental footprint. In any case, although described with reference to certain embodiments of the invention, it should be understood that these embodiments are only intended to be exemplary, not restrictive, such that various modifications can be made to the disclosed embodiments without departing from the invention. With this in mind, the invention is only intended to be limited to the scope of the following claims.

The invention claimed is:

1. A food container comprising:

a main body including a bottom joined to at least one sidewall to establish an interior compartment for storing a food product, the main body also including an upper rim extending radially outward from the at least one sidewall, with the upper rim having a ledge portion extending from the at least one sidewall and leading to a downturned portion;

a tamper indicator projecting from the main body below the ledge portion;

a cap including:

a compartment cover portion configured to extend across the upper rim;

a seal portion configured to be sealed to the ledge portion of the upper rim;

the downturned portion having a first section joined to the seal portion; and an opening tab extending, at a location about the cap, from the downturned portion, said opening tab being attached to the tamper indicator through a frangible element, wherein opening of the food container requires manipulation of the opening tab, breaking of the frangible element and unsealing of the interior compartment through removal of the cap, wherein, upon removal of the cap, the tamper indicator remains connected to the main body.

2. The food container of claim 1, wherein the downturned portion further includes a second section extending from the first section, the second section includes first and second spaced terminal ends, and the opening tab includes an upper tab body extending between the first and second spaced terminal ends of the second section.

3. The food container of claim 2, wherein the opening tab further includes a lower tab body, configured to be manually grasped for removal of the cap, extending below the upper tab body at a position spaced from the at least one sidewall.

4. The food container of claim 3, wherein the upper tab body is aligned with the second section about the main body and directly attached to the first section.

5. The food container of claim 3, wherein the lower tab body extends downward and radially outward from the upper tab body.

6. The food container of claim 3, wherein the upper tab body is directly attached to the tamper indicator through the frangible element.

7. The food container of claim 6, further comprising an additional frangible element connecting the tamper indicator to the cap.

8. The food container of claim 7, wherein the additional frangible element directly connects the tamper indicator to the seal portion of the cap.

9. The food container of claim 1, wherein the cap further includes a projection extending radially inward from the downturned portion and configured to snap-fittingly engage upper rim of the main body.

10. The food container of claim 1, wherein the interior compartment is sealed without a flexible membrane seal about the ledge portion, even when the frangible element is not broken, and an entirety of the food container is made from 100% recyclable material.

11. A food container comprising:

a main body including a bottom joined to at least one sidewall to establish an interior compartment for storing a food product, the main body also including an upper rim extending radially outward from the at least one sidewall, with the upper rim having a ledge portion extending from the at least one sidewall and leading to a downturned portion;

a cap including:

a compartment cover portion configured to extend across the upper rim;

the downturned portion having a first section joined to a seal portion; and an opening tab extending, at a location about the cap, from the downturned portion, wherein opening of the food container requires manipulation of the opening tab to unseat the seal member from the ledge portion; and a seal member configured to create a seal between the cap and the ledge portion of the upper rim, without a flexible membrane seal, said seal member being embedded in one of the cap and the ledge portion.

12. The food container of claim 11, wherein the cap further includes a seal portion configured to be seated upon the ledge portion of the upper rim, said seal member being embedded in the seal portion of the cap.

13. The food container of claim 11, further comprising a tamper indicator extending between the main body and the cap, said opening tab being connected to the tamper indicator through a frangible element configured to be broken upon manipulation of the opening tab.

14. The food container of claim 13 wherein, upon removal of the cap, the tamper indicator remains connected to the main body.

* * * * *